US005833933A

United States Patent [19]

Vance

[11] Patent Number: 5,833,933

[45] Date of Patent: Nov. 10, 1998

[54] INCANDESCENT WASTE DISPOSAL SYSTEM AND METHOD

[76] Inventor: Murry A. Vance, 1050 Miller Dr., Altamonte Springs, Fla. 32701

[21] Appl. No.: 941,389

[22] Filed: Oct. 1, 1997

Related U.S. Application Data

[62] Division of Ser. No. 401,271, Mar. 9, 1995, Pat. No. 5,676,056.

[51] Int. Cl.[6] ..... B01J 19/08

[52] U.S. Cl. ..... 422/186.21; 422/186.26; 422/906; 588/227

[58] Field of Search ..... 422/186.04, 186.21, 422/186.26, 906; 558/227

[56] References Cited

U.S. PATENT DOCUMENTS

| | | | |
|---|---|---|---|
| 3,779,182 | 12/1973 | Camacho | 110/8 R |
| 3,996,044 | 12/1976 | Petritsch | 75/10 R |
| 4,419,943 | 12/1983 | Faurholdt | 110/237 |
| 4,451,925 | 5/1984 | Sandoval | 373/81 |
| 4,770,109 | 9/1988 | Schlienger | 110/247 |
| 5,224,118 | 6/1993 | Vance | 373/60 |
| 5,333,146 | 7/1994 | Vance | 373/60 |

*Primary Examiner*—Kathryn L. Gorgos
*Assistant Examiner*—Kishor Mayekar
*Attorney, Agent, or Firm*—Allen, Dyer, Doppelt, Milbrath & Gilchrist, P.A.

[57] ABSTRACT

An incandescent Waste disposal system and method for the processing of waste and for rendering a hazardous component of the waste nonhazardous without discharge of harmful emissions are provided. The system includes a waste processing chamber, typically segmented into several sectors, wherein the waste is thermally and mechanically decomposed into a harmless residue by the action of rollers and an unrestricted arc plasma cloud that has a temperature sufficient to decompose the waste and render the hazardous component nonhazardous. The plasma cloud is created in a well-defined area in a reproducible manner and has a central region the temperature of which can reach 15,000°–22,000° F.

12 Claims, 6 Drawing Sheets

INCANDESCENT WASTE DISPOSAL METHOD

INCANDESCENT WASTE DISPOSAL SYSTEM AND METHOD

CROSS-REFERENCE TO RELATED APPLICATION

This is a divisional application of pending application Ser. No. 08/401,271, filed Mar. 9, 1997, issuing as U.S. Pat. No. 5,675,056 on Oct. 7, 1997.

BACKGROUND OF THE INVENTION

1. Field of the Invention

The present invention relates to systems and methods for destroying waste and, more particularly, to systems and methods for destroying waste on site in an environmentally safe manner and reduce it to a significantly smaller volume of nonhazardous material.

2. Description of Related Art

The disposal of waste materials has become an extremely important environmental issue. The particular category of hazardous waste includes toxic chemicals and flammable, radioactive, or biological substances. The most common methods of waste disposal in the United States comprise landfill and incineration.

In landfill disposal collection and transportation account for a large portion of the total cost. The choice of sites is partially governed by water table levels and the potential for pollution. In the case of hazardous waste, transportation and handling from the site of generation can be a potentially dangerous undertaking; toxic waste leakage from disposal sites has had catastrophic results in notorious cases such as the Love Canal area in New York.

In conventional incinerators refuse is burned on moving grates in refractory-lined chambers; combustible gases and the solids they carry are burned in secondary chambers. In addition to heat, the products of incineration include the normal primary products of combustion—carbon dioxide and water—as well as oxides of sulfur and nitrogen and other gaseous pollutants. Nongaseous products include fly ash and unburned solid residue.

In the particular case of biohazardous waste, conventional on-site disposal involves two types of processes: those that disinfect, sterilize, or decontaminate; and those that destroy, shred, contain, or grind. The first group is aimed at destroying or irreversibly inactivating germs, viruses, and other microorganisms that might otherwise cause illness to living creatures or damage the environment. The second group is aimed at precluding the possibility of reuse, injury, or improper end material disposal.

Most existing on-site disposal systems satisfy only one of these objectives and must be combined with additional off-site processing to complete the safe disposal of the biohazardous waste. Such systems have the disadvantage that they require the transportation and handling of biohazardous materials between the different steps required to render the waste safely disposable. Each handling occurrence adds to the chance for human or environmental contamination.

An alternative procedure for biohazardous waste disposal has been to transport the waste to a remote open air or forced air controlled combustion incinerator for processing. The biohazardous waste is disposed of through incineration at temperatures of 1800° F. or more for an accepted retention time of at least 2 seconds. Such combustible flame burning techniques, however, produce and discharge their own hazardous gas waste and ash directly into the atmosphere and environment. They also require the transportation and handling of the untreated waste from the site of generation to the incineration site, which adds to the cost of disposal and increases the chance of mishap.

A system for on-site biohazardous waste disposal has been disclosed by the present inventor in U.S. Pat. Nos. 5,224,118 and 5,333,146, the specifications of which are incorporated herein by reference.

SUMMARY OF THE INVENTION

It is an object of the present invention to provide a waste disposal system and method for the processing of waste without the discharge of harmful emissions.

It is another object to provide such a system and method for rendering a hazardous component of the waste nonhazardous.

It is an additional object to provide such a system and method that can be utilized on site, thereby obviating the need for waste transport and excess handling.

It is a further object to provide such a system and method that entails neither burning nor the introduction of flammable fuels or chemicals.

It is yet another object to provide such a system and method that requires low power consumption, operates with low gas flow, recovers process heat, recycles process gases and processes waste material for reuse or disposal.

These and other objects are achieved by the waste disposal system and method of the present invention for the processing of waste and for rendering a hazardous component of the waste nonhazardous without discharge of harmful emissions.

The waste disposal system is an incandescently heated system that changes the composition of waste to result in a manageable solid residue and cleaned gases. In most situations the processed waste emerging from the system will be of such quality as to be dischargeable into a sewer system. In a preferred embodiment, a particular waste product, carbon black, is filtered from the waste stream and collected for reuse.

The waste disposal system generally comprises a waste processing chamber wherein the waste decomposition process occurs, means for admitting waste into the chamber, and means for discharging the decomposed waste from the chamber.

The process is achieved by exposing the waste admitted into the chamber to intense incandescent heat, the medium for which comprises an inert gas, and thus the system also includes means for admitting the inert gas into the chamber. Within the chamber is a means for creating an unrestricted arc plasma from the inert gas. The arc plasma is created and controlled to have a temperature sufficient to decompose the waste and render the hazardous component nonhazardous.

In a preferred embodiment, the means for creating the arc plasma comprises means for creating an arc plasma in a portion of the chamber separated from the admitting means by a gap. In order to facilitate the decomposition process, means are positioned within the chamber gap and adjacent the admitting means for mechanically reducing the waste pieces prior to exposure of the waste pieces to the arc plasma. This increases the surface area of the waste pieces exposed to the arc plasma, thereby facilitating the decomposition process.

Finally, residue collecting means are included adjacent the discharging means for collecting the discharged decomposed waste from the discharging means. In a preferred embodiment, means are positioned within the chamber for separating the decomposed waste into a gaseous and a solid component, and the discharging means comprises means for discharging the gaseous component and means for discharging the solid component. More particularly, there are provided means for mechanically reducing the solid component into a residue having a maximum dimension of ⅛ inch for delivery to the solid component discharging means and gas collecting means for collecting the gaseous component for delivery to the gaseous component discharging means. Two specific components of the decomposed and processed waste, the inert gas and carbon black, can be reclaimed and reused.

Specifically, there are provided means positioned outside the chamber for reclaiming from the gaseous component the inert gas. The reclaiming means are connected at a first end to the gaseous component discharging means and are connected at a second end to the inert gas admitting means. This permits the conservation and reuse of the inert gas in the process.

Typically, the waste enters the system as pieces of waste, and means are positioned within the chamber and adjacent the arc plasma for mechanically reducing the waste pieces in the arc plasma. This reduction serves to render the waste pieces into smaller-sized pieces to increase the surface area of the waste pieces exposed to the arc plasma, thereby facilitating the decomposition process.

In a particular embodiment, the mechanical reduction means comprise a pair of rollers having generally parallel axes. Specifically, the rollers are affixed within the chamber so as to be positioned beneath entering waste. The rollers are further adapted to rotate in opposite directions, the rolling action at the adjacent surfaces in a downward direction. Gravity then impels the waste pieces toward the top of the rollers, and the rolling action further impels the waste to proceed between them. The surfaces of the rollers are a predetermined distance apart, and, in their rolling action, reduce the size of the waste pieces passing therebetween to a size commensurate with the separation distance of the rollers.

Also in a specific embodiment, the arc plasma creating means comprises an anode affixed within the chamber and a plurality of unrestricted plasma arc torches, each having an electrode tip pointing generally toward a central region of the chamber. Each electrode tip is positioned at most a maximum firing distance away from the anode. The arc plasma creating means further comprises a means for firing the plasma torches having sufficient voltage to create an arc between the electrode tips and the anode and a means for sustaining an electric current flow from the electrode tips to the anode.

In this specific embodiment, each unrestricted plasma arc torch when fired creates a conically shaped plasma cloud. The anode comprises a pair of rollers having generally parallel axes affixed a predetermined distance apart for mechanically reducing pieces of waste passing between them. The pair of rollers are dimensioned and positioned so that all solid waste entering the chamber must pass between the respective pair of rollers. In use the conically shaped plasma cloud of each torch interacts with and overlaps a conically shaped plasma cloud of an adjacent torch to form a defined cloud region having a temperature higher than the temperature achievable by a unitary torch.

As the waste enters the plasma cloud, it becomes an active anode for the plasma arc, which allows for a flow of arc electrons directly into the waste, which undergo collisions with the waste molecules and efect bond breakage.

The method of the present invention comprises the steps of admitting waste into a chamber, admitting an inert gas into the chamber, and creating an unrestricted arc plasma from the inert gas within the chamber. As above, the arc plasma has a temperature sufficient to decompose the waste and render the hazardous component nonhazardous. When the process has been completed, the decomposed waste is discharged from the chamber and collected.

A further step of the method comprises the step, following the waste admitting step, of mechanically reducing the waste into smaller-sized pieces of waste to increase the surface area of the waste pieces exposed to the arc plasma, thereby facilitating the decomposition process.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

A description of the preferred embodiments of the present invention for the processing of waste will now be presented with reference to FIGS. 1–6. The discussion is broken down into various aspects, including the mechanical and electrical aspects of the waste processing and disposal system; the control system hardware and software; and the method of operation, including safety considerations.

System for Processing and Disposing of Waste

The multistage waste processing and disposal system 10 of the present invention decomposes waste 12 via electrically generated incandescent heating and electron-molecule collisions. The temperatures achieved and electron flow characteristics of the system are sufficient to rendering a hazardous component of the waste nonhazardous, while at the same time avoiding any discharge of harmful emissions.

Figure 1:
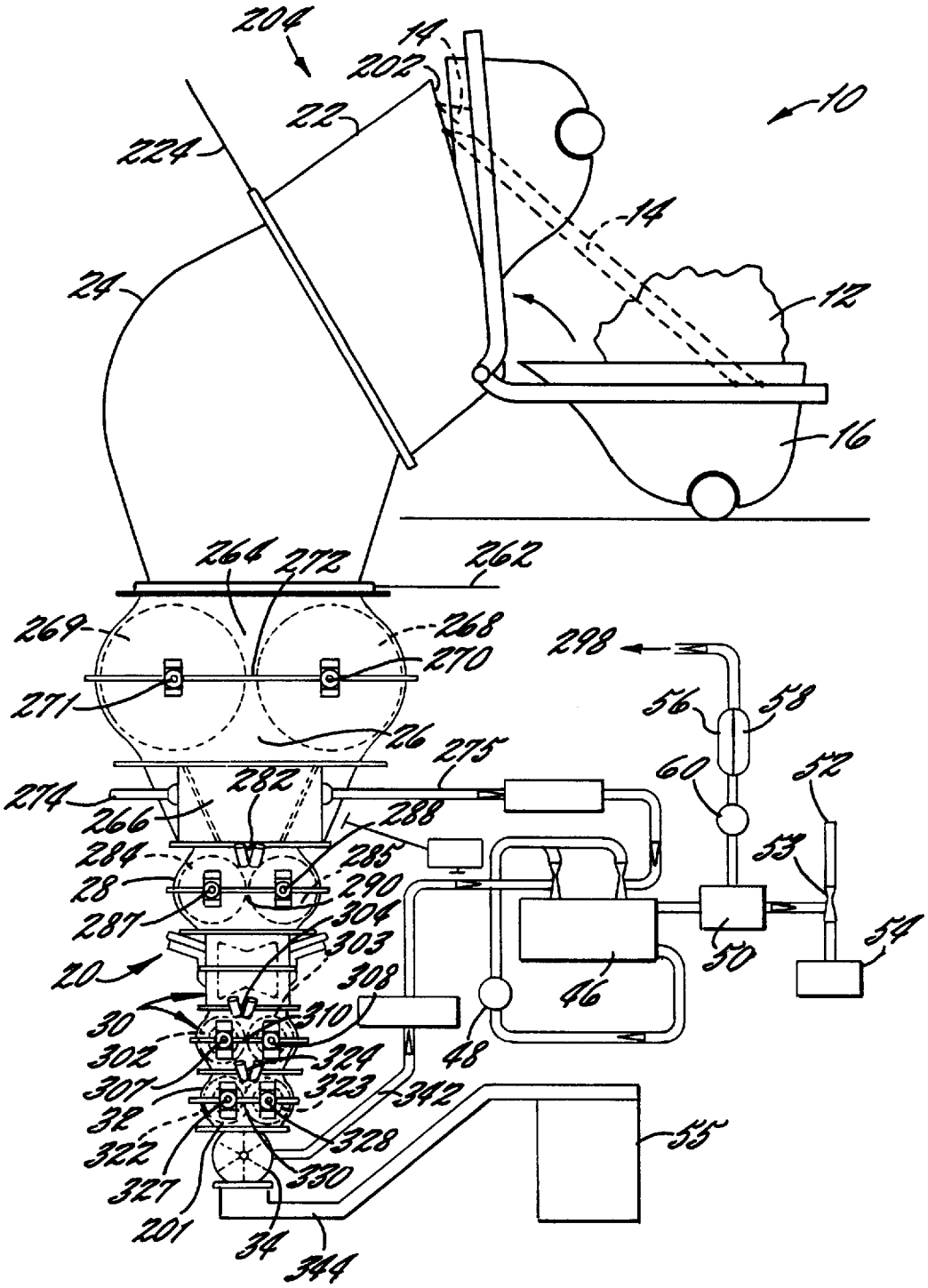
FIG. 1 illustrates the waste disposal system of the present invention.

The waste processing chamber 20 of the system has an interior wall surface 201 lined with a ceramic material that can withstand temperatures up to 4000° F. As shown in FIG. 1, chamber 20 has an opening 202 at a top end 204 for admitting waste 12 into the chamber 20. In a preferred embodiment a cart 16 is pivotally affixed to the chamber 20 adjacent this opening 202. Cart 16 is remotely hydraulically liftable to an "up" position after being loaded to transfer the waste from cart 16 to the first, topmost segment 22 of the chamber 20. Once the cart 16 is emptied, a sensor 142 signals a computer 90, which in turn signals cart lift 14 to return the cart 16 to its "down" position.

The first segment of the chamber, adapted to receive waste from the opening 202, comprises a load hopper 22, which is a storage device for the waste having a capacity greater than that of the cart 16 to ensure that all waste is securable.

Between load hopper 22 and the second segment, a holding chamber 24, is a primary inclined gate valve 224, which is under computer control for opening and closing. Valve 224 is not signalled to open until the computer is signalled by sensors that the load hopper 22 is loaded and holding chamber 24 is empty. Valve 224 is a means for sealing off the opening 202 during waste processing for retaining the inert gas and decomposed gas within the chamber 20.

Holding chamber 24, then, holds waste preparatory to processing, which begins in the third segment 26, wherein the first phase of processing begins, namely, a first mechanical reduction and a preheating of the waste. Between the holding chamber 24 and the third segment 26 and controlling waste movement therebetween is positioned a secondary inclined gate valve 262, also under computer control. Upon detection of predetermined operating parameters, to be discussed in detail in the Control section, secondary inclined gate valve 262 opens, permitting waste to enter the third segment 26, until waste is completely emptied from holding chamber 24, whereupon valve 262 closes.

Third segment 26 comprises two main sectors: a feed sector 264 and a preheating sector 266. Within the feed sector 264 are affixed a first pair of rollers 268,269 having generally parallel axes 270,271. Rollers 268,269, which have a ribbed surface, are rotatably affixed within the feed sector 264 a first distance 272 apart. In a preferred embodiment, distance 272 is approximately 37 inches.

Each of the four sets of rollers to be described herein is adapted to mechanically reduce pieces of waste passing therebetween. In each case each set of rollers is dimensioned and positioned so that all solid waste entering a respective chamber segment must pass between its respective pair of rollers. In addition, a first one of each roller pair is adapted to rotate in an opposite direction to a rotation of a second one of each roller pair, thereby impelling waste impinging thereon to proceed therebetween. Further mechanical reduction is ensured by the relative positioning of the roller sets, each of which is offset 90 degrees from its vertical nearest-neighbor set. The roller sets are also offset in a horizontal direction, which prevents any waste from falling directly downward and passing through all four sets of rollers.

In this embodiment, gravity and the rollers together serve as the means to transport the waste through the chamber 20 in sequence from the first through to the sixth segment, with the roller pair rotations being directed to move waste sequentially from the third through to the sixth segment. Specifically, as can be seen in FIG. 1, roller 269 rotates in a clockwise direction and roller 268, in a counterclockwise direction, impelling waste in a downward direction from the feed sector 264 into the preheating sector 266. Similar conditions obtain for the other three roller pairs.

Waste is moved into preheating sector 266 by first set of rollers 268,269 when a signal informs the computer that preheating sector 266 is empty. The temperature in preheating sector 266 typically reaches 400°–800° F., which is caused by rising hot gases from the waste processing occurring therebelow in subsequent segments and also by a heat exchange system (discussed below). This temperature is sufficient to begin disintegrating temperature-sensitive waste.

Leading out of preheating sector 266 to the exterior of the chamber 20 is a set of gas eductors 274,275, which siphon hot gases out of the preheating sector 266 into a filtering and disposal system, to be discussed below.

Positioned beneath and leading from preheating sector 266 is a fourth segment 28, which has a smaller cross-sectional area than that of the preheating sector 26. Within the fourth segment waste is heated to a first predetermined temperature, typically in the range of 3000° F. This temperature is attained by the action of a first set of unrestricted arc plasma torches 282 aimed generally toward a second pair of rollers 284,285, which serve as an anode, being made of a material suitable for this use, as are the third and fourth pairs of rollers, which will be discussed below. All sets of torches operate with an inert gas atmosphere, in the preferred embodiment, argon. The higher temperature in this segment further disintegrates the waste.

Figure 5:
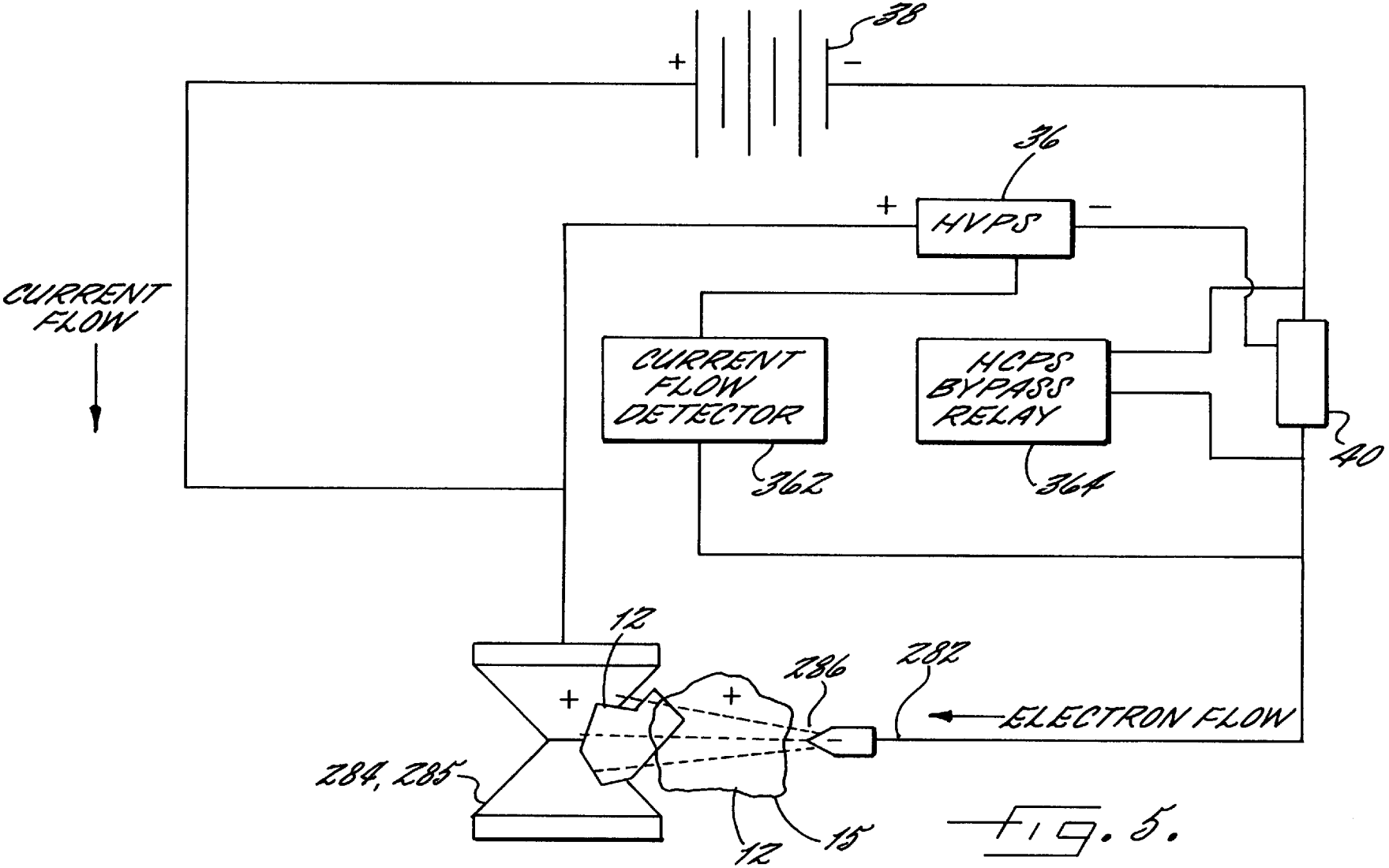
FIG. 5 shows the circuit diagram for a plasma torch.
Figure 6:
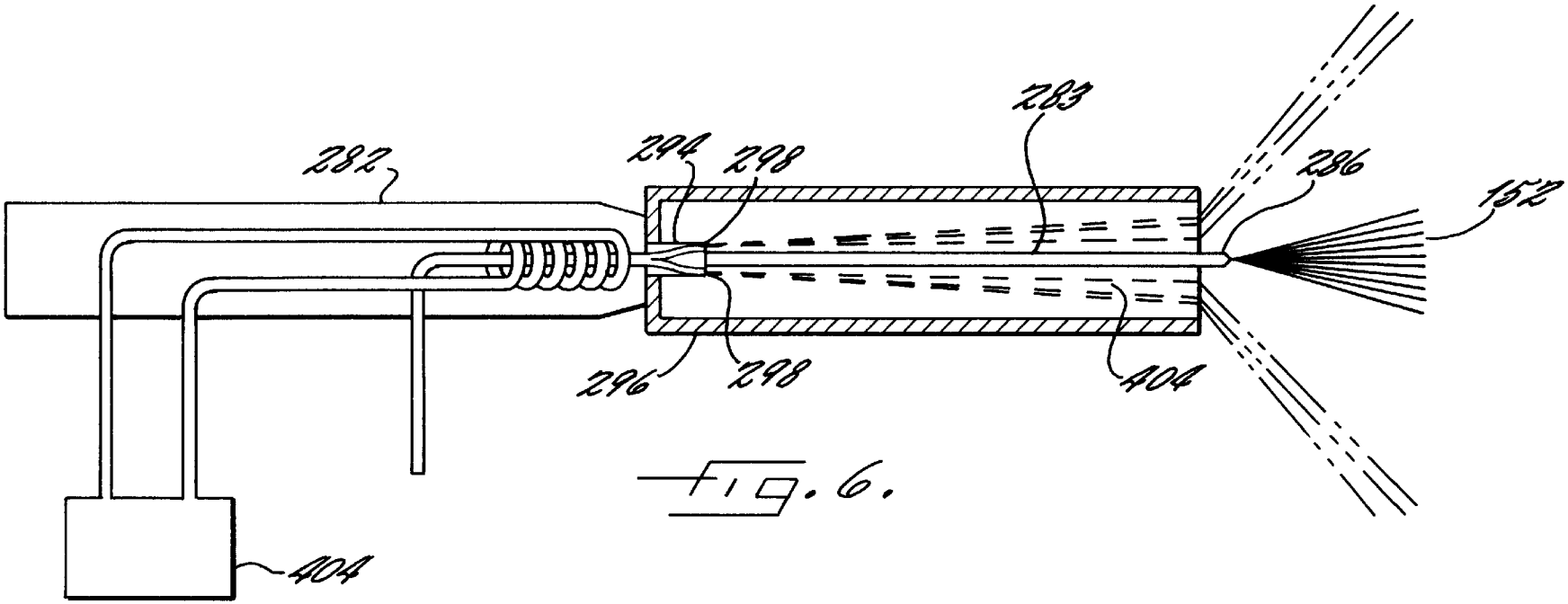
FIG. 6 illustrates the components of a plasma torch.

Each one of the first set of unrestricted plasma arc torches 282 is adapted to protrude into the fourth segment 28, and each has an electrode 283 having a tip 286 pointing generally toward a central region of the fourth segment 28 (see FIGS. 5 and 6). In order to form the necessary arc, each electrode tip 286 is positioned at most a maximum firing distance away from the second set of rollers 284,285. This distance in practice is less than 3 inches.

The second pair of rollers 284,285, which are grooved, have generally parallel axes 287,288, and are rotatably affixed beneath torches 282 within the fourth segment 28 a second distance 290 apart. Distance 290 is dimensioned smaller than the first distance 272; so the rolling action of the second pair of rollers 284,285 further mechanically reduces pieces of waste passing therebetween. In a particular embodiment, distance 290 is approximately 17 inches. The surface temperature of rollers 284,285 is approximately 2000° F., which additionally aids in the decomposition process.

The waste emerging from rollers 284,285 next enters a fifth segment 30, which has a smaller cross-sectional area than that of the fourth segment 28. In fifth segment 30 a second predetermined temperature is reached that is greater than the first predetermined temperature. Specifically, this temperature is approximately 6350° F. This temperature is attained by the action of a second set of unrestricted arc plasma torches 304 aimed generally toward a third pair of rollers 302,303, which serve as an anode. The yet higher temperature in this segment 30 continues the thermal disintegration of the waste.

Each one of the second set of unrestricted plasma arc torches 304 is adapted to protrude into the fifth segment 30, and each has an electrode tip 306 pointing generally toward a central region of the fifth segment 30. In order to form the necessary arc, each electrode tip 306 is positioned at most a maximum firing distance away from the third set of rollers 302,303. This distance in practice is less than 3 inches.

Rotatably affixed within fifth segment 30 and beneath torches 304 is the third pair of rollers 302,303, having generally parallel axes 307,308. The roller surfaces are a third distance 310 apart, this third distance 310 again smaller than the second distance 290 for yet further mechanical reduction of pieces of waste passing therebetween, in practice 14 inches. In practice the third pair of rollers 302,303 attains a temperature of 2200° F., which is sufficiently high to vaporize any liquid component of the waste impinging on these rollers.

After emerging from between the third pair of rollers 302,303, the waste enters a sixth segment 32, which has a cross-sectional area smaller than that of the fifth segment 30. In this segment 32, the waste is heated to a third predetermined temperature greater than the second predetermined temperature. Specifically, this temperature is in the range of generally 15,000°–22,000° F. This temperature is attained by the action of a third set of unrestricted arc plasma torches 324 aimed generally toward a fourth pair of rollers 322,323, which serve as an anode. The yet higher temperature in this segment 32 completes the thermal disintegration of the waste.

Each one of the third set of unrestricted plasma arc torches 324 is adapted to protrude into the sixth segment 32, and each has an electrode tip 326 pointing generally toward a central region of the fifth segment 32. In order to form the necessary arc, each electrode tip 326 is positioned at most a maximum firing distance away from the third set of rollers 322,323. This distance in practice is less than 3 inches.

Rotatably affixed within sixth segment 32 and beneath torches 32 is the fourth pair of rollers 322,323, having generally parallel axes 327,328. The roller surfaces are a third distance 330 apart, this third distance 330, in practice 11 inches, again smaller than the second distance 310 for yet further mechanical reduction of pieces of waste passing therebetween.

After emerging from between the fourth pair of rollers 322,323, the waste is separated into gaseous and solid components by a rotary seal valve 34, which seals off the chamber outlets during waste processing. The gaseous and solid components then proceed to separate outlets 342 and 344, respectively, for discharging the processed waste components from the chamber 20 to residue collecting means positioned adjacent the outlets 342 and 344 for collecting the discharged waste components.

In an alternate embodiment, a fourth set of torches is provided for additional waste processing capability and to enhance the speed of the system.

The method of producing a plasma cloud using unrestricted arc plasma torches will now be described, using the first set of torches 282 in fourth segment 28 as an example (see FIGS. 4–6).

A plasma is a gaseous state of matter in which a part or all of the atoms or molecules are dissociated to form ions. Plasmas are good conductors of electricity, and can be created by applying an electric field to a low-pressure gas, as is done in neon or fluorescent tubes. When the electrical current is sufficiently high, the gas ionizes.

In the case of an electric arc, a continuous electric discharge that gives off light and heat, a large current applied to an electrode causes a stream of electrons to pass from the electrode tip to an anode, heating the anode. This phenomenon is utilized in arc welding, a specific example of which is gas-tungsten arc welding, wherein a tungsten electrode is used in an inert gas atmosphere to prevent oxidation (see FIG. 6). Specifically, the electrode 283 is surrounded by a ceramic cup 294, which is in turn surrounded by a cup 296 having holes 298 through which the inert gas is admitted into the chamber 20.

The preferred inert gas utilized in the chamber of the present invention is argon, a monatomic molecule that when ionized forms a single positive ion and an electron. In the present invention, the physical properties of argon permit its ionization under conditions of firing the unrestricted plasma arc torch 282 in the argon atmosphere within the chamber. The argon ion plasma cloud 15 that is formed has a net positive charge and serves as a conductive medium for the electron flow as an anode for the arc.

Argon is also the third most prevalent gas in the earth's atmosphere, making it readily abundant. In addition, argon is a poor conductor of heat, making the edges of the plasma cloud 15 relatively cool (approximately 3000° F.) and also cooling the electrode tips 286. Specifically, the thermal conductivity of the argon is sufficiently low to provide an effective thermal barrier between the plasma cloud 15 and the chamber interior wall surface 201. This prevents a substantial amount of heat from being transferred from the plasma cloud 15 to the chamber interior wall surface 201.

An additional benefit of the positively charged argon ions is that, as they are drawn toward the electrode tip 286, their flow serves to clean the electrode 283 of oxides by removing built-up debris in an action akin to sand-blasting.

The torches used in a preferred embodiment comprise tungsten inert gas (TIG) unrestricted plasma arc torches that have water-cooled bodies. Unlike the situation encountered with restricted plasma arc torches, which require a high-pressure gas flow (approx. 300 psi), the TIG torch system employed herein requires only 3 psi argon, the minimum pressure required to keep the ionized argon from flowing back to the electrode. An argon volume of 15–20 cubic feet per hour is used per torch.

A schematic circuit diagram for the firing of each torch is shown in FIG. 5, using torch 282 as an example. In the system, this circuit applies for all three (or four, in the alternate embodiment) sets of torches and their respective anode rollers, with the sets of torches fired sequentially from the bottom up, that, is, from the third (or fourth, in the alternate embodiment) through the first set.

Each torch, 282, for example, is fired by a high-voltage power supply 36 connected to an electrode tip 286 through a high-voltage coupler 40. The high-voltage power supply 36 must have sufficient voltage to create an arc between the electrode tip 286 and the respective set of rollers 284,285. In practice, the high-voltage power supply delivers 9–12 kV across the coupler 40 to the tip 286. The high-voltage power supply 36 need not run continuously and typically performs a 5 second on/off sequence attempting to ignite the torch 282 to form an arc. When the current detector 362 measures flow, it signals the coupler bypass relay 364 to engage and turns off the high-voltage power supply 36. The arc thus created is sufficient to ionize a sufficient amount of the argon to form an unrestricted arc plasma from the argon.

The electric current flow of approximately 200–300 A between the electrode tip 286 and the anode (rollers and waste) is sustained by a high-current, low-voltage power supply 38 connected to the electrode tip 286.

While individual TIG torches can produce temperatures in the range of 5000°–6350° F., a significant enhancement of the technology enables the attainment of the above-recited 15,000° F., namely, the creation of a controlled plasma cloud by the interaction of the ionized plasmas induced by the firing of a plurality of torches. The temperature attained by this arc plasma and the electron flow characteristics within the plasma cloud are sufficient to decompose any known material and to render a hazardous component nonhazardous, with the exception of radioactivity and asbestos.

Figure 4:
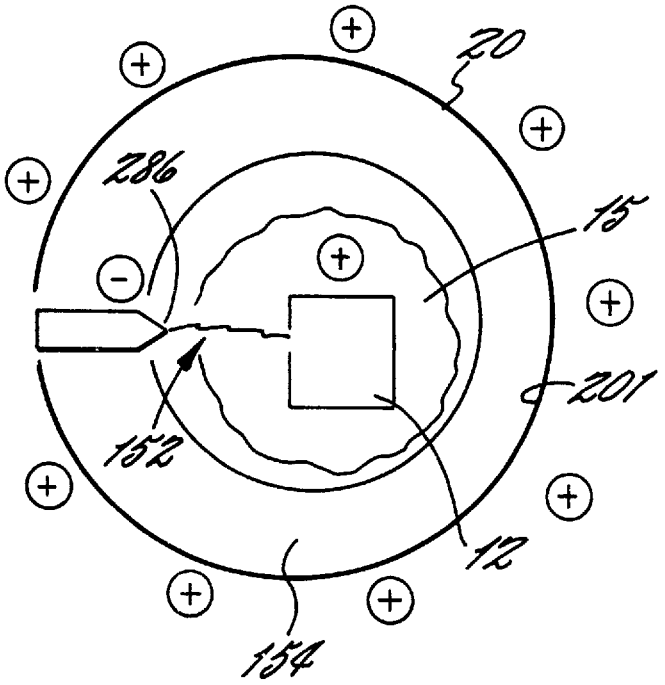
FIG. 4 illustrates the unrestricted arc plasma cloud as produced in the waste disposal chamber.

Each electrode tip 286 produces a conically shaped plasma arc 152 (FIGS. 4 and 6). In a preferred embodiment, three torches are used in each set, spaced apart by generally 120°. It has been found that the overlap of the each individual conical plasma arc 152 with another conical arc of an adjacent torch in its set creates an interaction in the form of additional collisions, and thus additional heat, within a well-defined positively charged central cloud region 15 that is controllable and reproducible within the chamber 20 of the present invention. As mentioned previously, the outer edges of this cloud are relatively cool, and therefore the lining 201 of the chamber 20 is not exposed to the extremely high temperatures that are found in the central cloud region 15. The chamber walls and rollers have the same positive charge as the plasma cloud and tend to repel the plasma cloud, which assists in controlling the high-temperature plasma cloud. Thus a cooler region 154 of primarily unionized low-thermal-conductivity inert gas is maintained between the chamber interior wall surface 201 and the plasma cloud 15.

A maximum segment diameter has been found to be approximately 17 inches in order to sustain an unrestricted arc plasma cloud. This dimension provides an electrode-to-electrode distance of 14 inches.

In order to provide adequate plasma cloud coverage from segment to segment, the radial torch positions are staggered 40° between adjacent segments. Thus, if one torch should become extinguished, and a piece of waste should fall through an area of substandard temperature, the subsequent segment's plasma cloud is unlikely to be avoidable by the waste piece.

It is noteworthy that, in proceeding from the fourth through the sixth chamber segments, the plasma cloud temperature increases dramatically. This phenomenon results from the progressive narrowing of the segments, since the plasma becomes more efficient with a decrease in volume. It is known in plasma physics that a decrease in cross-sectional area leads to an exponential increase in electron flow, which would explain this phenomenon.

The systems external to the chamber 20 for handling and disposing of the decomposed waste will now be discussed, again with reference to FIG. 1. The decomposed waste to be disposed of or reclaimed typically comprises water, carbon black and residue from the processing of organic matter, and inorganic products.

Gases may leave chamber 20 by two routes: from the hot gas eductors 274,275 exiting from the third chamber segment 26; and from the rotary seal valve 34 at the bottom of the chamber 20.

Those leaving via eductors 274,275 and those leaving from the rotary seal valve 34 similarly proceed, respectively, via pipes through carbon black filters 42,43, into Venturi tubes 44,45, and into a common separator tank 46. The eduction systems contain no moving parts, using the water flow through the Venturi tubes as the motive to create a suction and also to mix the gases with water. A circulation pump 48 circulates the water through the separator tank 46, which scrubs the gases for release to an argon reclamation tank 50, which is capable of reclaiming 80% of the argon used in the system. The nonargon gases are mixed with supply water 52 via Venturi tube 53 and are discharged into the sewer system 54. This water has been shown to meet drinking water standards.

Argon is supplied to the nozzles 298 from one of two cylinders 56,58. When the cylinder being used is sensed as being empty, a solenoid for the empty cylinder is closed and a solenoid for the full cylinder is opened. Each cylinder 56,58 also comprises a manual shutoff valve for connecting/disconnecting each cylinder. The argon reclamation tank 50 also feeds, via compressor 60, the cylinders 56,58 so that argon may thus be recycled.

Each of the carbon black filters 42,43 comprises a dual filter that may be switched between when one filter sector is filled by a double-acting solenoid control. The carbon black may be reclaimed and reused for other purposes, such as a pigment in inks and paints or as a filler and reinforcing agent for rubber. The highly activated carbon black also binds heavy metals in a nonleachable lattice and is nonpolluting in this form.

Solid residue discharged from the solid waste component outlet 344 is collected and discharged into a trash receptacle 55 for reuse or directly into a sewer system 54, depending upon local ordinances.

The preheating sector 266, as mentioned, receives heat transferred from a heat exchanger and circulating means 23 for recovering heat from the chamber outlet for hot gases 342. This process facilitates preheating of the waste in the third segment 26.

A further component exterior of the chamber 20 comprises a means for cooling the torches, which typically consists of a coolant system 404 that directs cooling fluid around the electrode (see FIG. 6).

Control System Components

Figure 2:
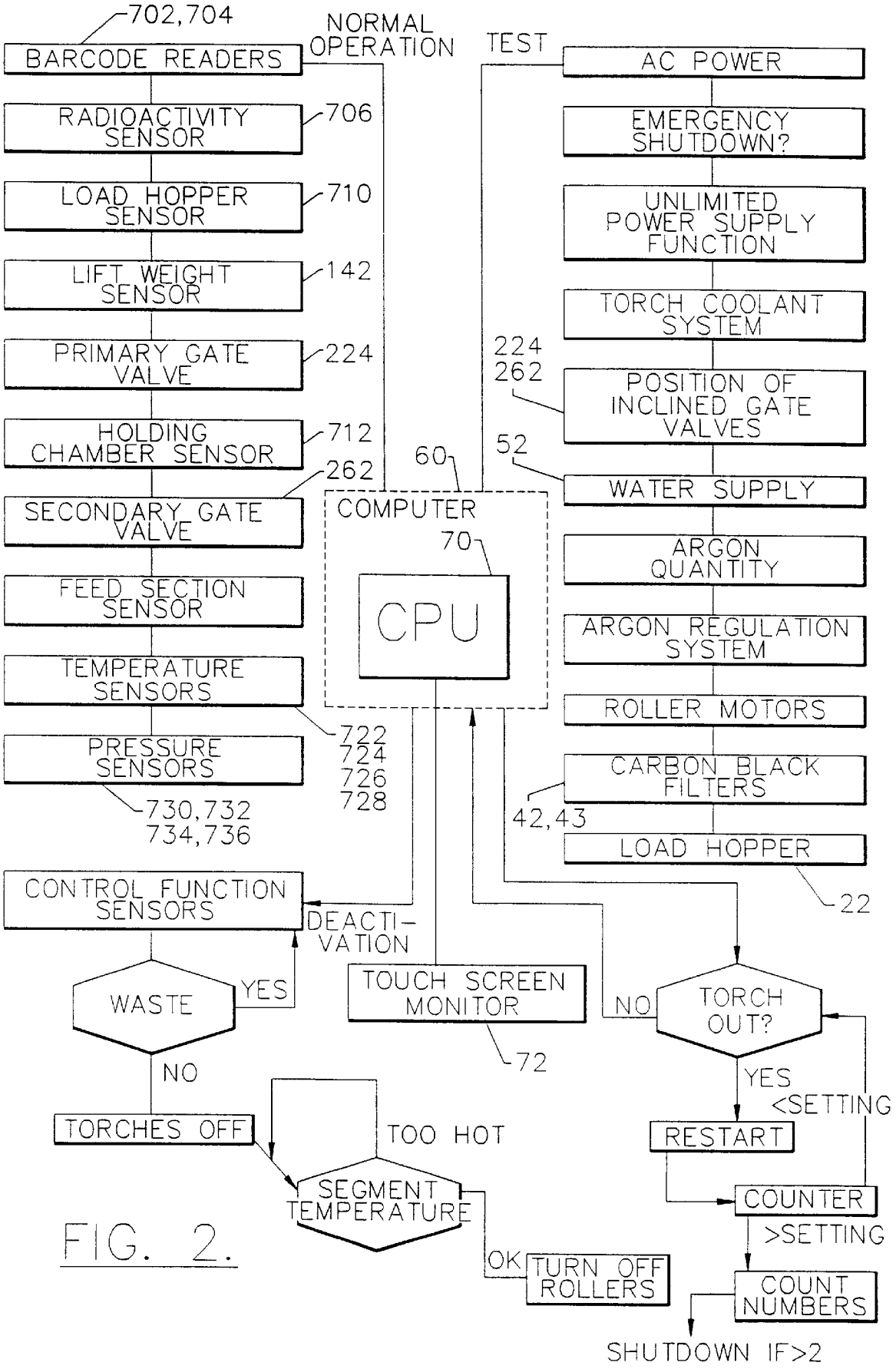
FIG. 2 is a schematic diagram of the control system of the present invention.

The waste processing and disposal system of the present invention is monitored and controlled by a computer 60 with only limited interface with the operator. A schematic diagram of the control system is shown in FIG. 2. Operator interfaces will be discussed in the following section.

An exemplary computer system comprises a CPU 70 having a processor with 16 MB RAM, a video card, tape backup, an internal fax/modem card, bar-code interface card, two printer ports (one for a standard printer and one for a bar-code label printer), and one disk drive. The monitor 72 has a touch screen overlay.

The system software has several functions: providing an interface with the operator, controlling the activity of various aspects of the system in response to predetermined sequences of events and to sensed system conditions, creating a report for tracking each container of waste processed by the system, building a database that will aid in troubleshooting, maintaining a database to aid a field engineer in repairs, and providing a communications link with a field engineer remote from the site.

Prior to processing waste, the first time the system is activated the computer 60 directs a self-diagnostics test, which includes testing: ac power, the absence of an emergency shutdown, unlimited power supply function, torch coolant system, the position of the primary inclined gate valve 224, the water system for pulling a vacuum through the eductors, amount of argon, argon regulating system, carbon black filters for fullness, roller motors, and load hopper emptiness.

During waste processing, if a torch is detected as having gone out, the computer 60 will direct an attempt to respark the torch. If this fails after a predetermined number of attempts, the waste will continue to be processed, unless three torches in any one segment are inactive, in which case the system will be deactivated.

When the system 10 is to be deactivated, the computer 60 directs a test that includes coordinating data from the sensors with control functions. It is determined that the waste in the chamber 20 has been fully processed by polling for material in the load hopper 22 and by detecting the load on the roller motors, which is indicative of the presence of material. The torches, if on, are turned off. When the temperatures in the segments drop to preset values, the rollers are turned off. Argon is regulated for positive pressure to keep oxygen out to prevent combustion. Then a logon cycle can be begun again.

The system is configured so that each container of waste can be given a bar code serial number for tracking purposes. The bar code is read by reader 702. The container may also be checked for radioactivity by radioactivity sensor 706.

A weight sensor 142 weighs the contents of the cart 16 to record processed waste. This sensor 142 also informs the computer 60 when cart 16 is empty so that the cart 16 can be returned by the lift 14. A first waste sensor 710 in the load hopper detects the presence of waste in the load hopper 22. A second waste sensor 712 in the holding chamber informs the computer 60 as to whether the holding chamber 24 is empty or has waste therein.

Once waste has entered the holding chamber 24, the primary inclined gate valve 224 seals the holding chamber 24, and the atmosphere is removed from the second through the sixth chamber segments. The computer 60 directs the argon admitting means to saturate the chamber with argon; the rollers, the arc torch coolant system, the filter system, and the water discharge are turned on; and the torches are activated and sparked until current flow is obtained. After current flow is detected, the spark device is turned off. Specifically, when the current detector measures flow, it signals the coupler bypass relay to engage and turns off the high-voltage power supply. When optimum operating parameters are sensed in the system, the secondary inclined gate valve 262 is opened, permitting waste to enter the third segment 26. When the holding chamber 24 is indicated to be empty by sensor 712, the secondary inclined gate valve 262 is closed.

The presence of waste in the fourth through the sixth segments 28,30,32 is sensed by sensing the load on the motors that power the respective roller sets therein (see FIG. 2). A load higher than that present when the chamber is empty is indicative of there being waste in that chamber.

First through fourth temperature sensors 722,724,726,728 and pressure sensors 730,732,734,736 are placed in the third through the sixth segments, respectively, for monitoring and so that a report can be generated for each load of material processed.

With the input from the temperature and waste sensors, computer 60 controls the flow of waste through the system and also the operating parameters such as pressure and temperature in order to ensure that the predetermined sequence of events are followed correctly and safely to process the waste.

Operator Interface and Safety Systems

Figure 3:
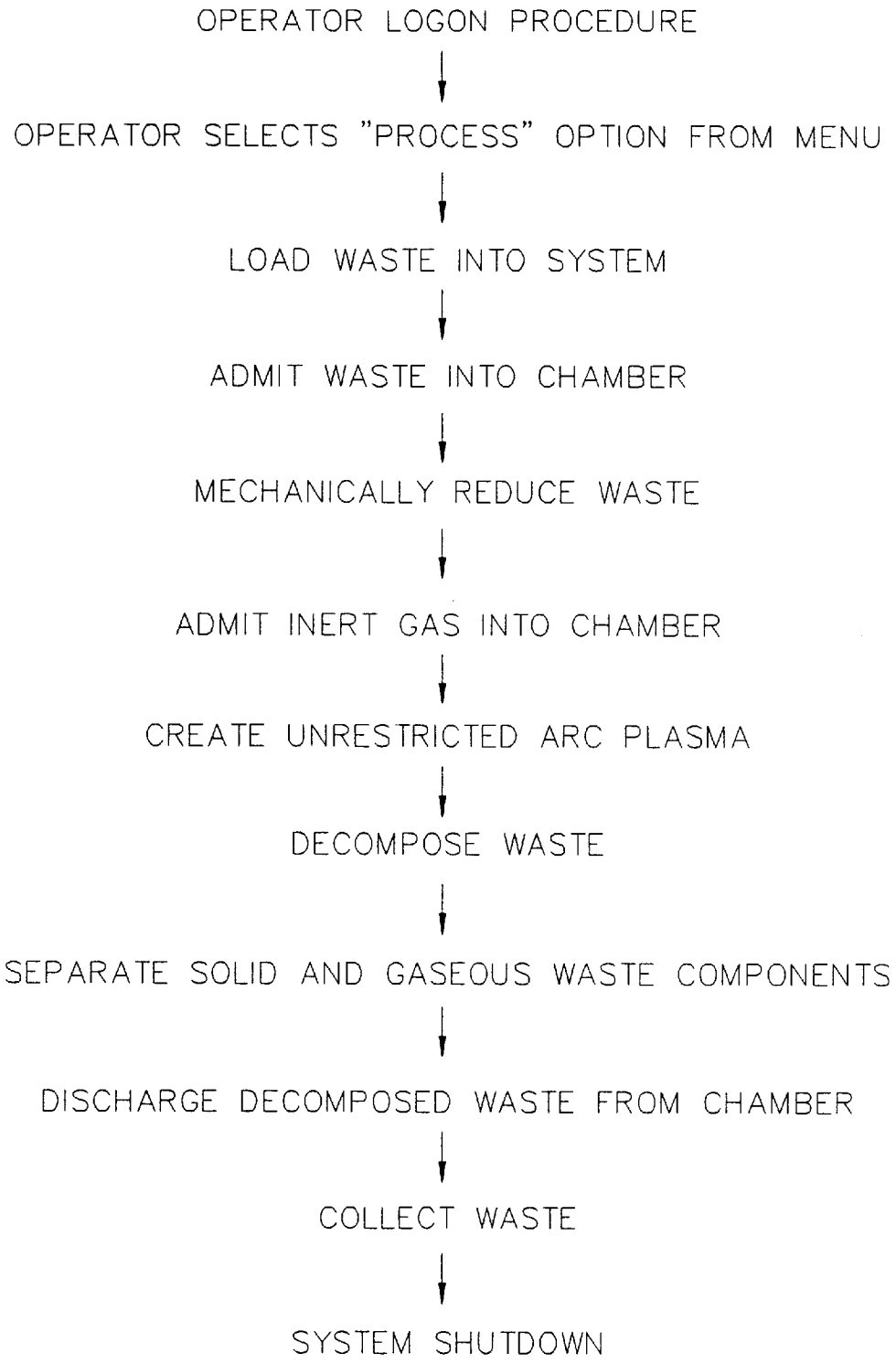
FIG. 3 shows the steps followed in the processing of waste using the waste disposal system of the present invention.

The system of the present invention is designed to restrict operator access to the machinery and to prevent unqualified operators from logging on (see FIG. 3).

When an operator indicates via the touch screen that he/she wishes to log on, an access code must be entered that is unique to that operator, such as a Social Security number and a person ID code. The computer checks this operator's history for authorization and also the time elapsed since last operating the equipment. If the elapsed time is determined to be greater than a predetermined amount, the operator is required to complete a test and simulation chosen from three levels of difficulty depending upon the elapsed time. If the operator fails the test, access is denied, and supervisor intervention is required. The system contains several different levels of accessibility depending upon authorization.

If the operator is granted access, the Main Menu appears on the screen, and the operator can select from among Reports, Process, Utilities, and End. If none is chosen after a certain time, the system recycles for logon.

If the Process option is chosen, the self-diagnostics test described above is undertaken. If this is successful, a message to that effect is displayed, and the Process Menu appears, which provides a choice between Load, Save Load, Process Load, Return to Main Menu, or End. No choice results in a return to the Main Menu.

Selecting the Load option leads to the computer verifying the operation of the loading sensors, the bar code readers, the operation and location of the cart lift, the position of the holding chamber valves, the chamber temperature and pressure values, and the load station entrance. Once these are verified as being acceptable, the operator is instructed to Start Loading Process.

The loading process begins when the operator moves a container of waste into the -cart lift through the load station entrance, passing the bar code reader and breaking a safety beam at the entrance. The computer compares the bar code read with that previously entered to ensure that the correct load is being loaded. If desired, the presence of radioactivity may be tested for. A sensor detects that material is present in the cart, and when the safety beam is unbroken the lift is advanced to load the waste into the load hopper and on into the holding chamber. Further material can be loaded until the holding chamber is full, at which point a Loading Complete message will appear.

When the Process Load option is selected, the system begins the processing as described above. If Save Load is chosen, the waste remains in the holding chamber.

During processing, no operator intervention is allowed until conditions are acceptable for additional waste loading or machine shutdown. If an abnormality is detected, the operator can press an Emergency Stop button.

As the processing proceeds, a graphic display simulates the waste's movement and location in the chamber segments. The ignition, amperage, and temperature are displayed on the screen, and the rollers' rotation is simulated on the screen. Additional displays are: argon cylinder volume, carbon filter condition, elevator position, primary and secondary inclined gate valve positions, segment operating temperatures and pressures, operator name, date, and time.

When processing is complete, the shutdown process is automatically undertaken, and the Main Menu reappears. Generally the Report option is then chosen, directing the computer to provide a printout detailing the waste's destruction.

It may be appreciated by one skilled in the art that additional embodiments may be contemplated, including those having alternate modes of moving the waste through the system and a chamber having a different number and configuration of segments.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus and method illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A multistage waste disposal system for the processing of waste and for rendering a hazardous component of the waste nonhazardous without discharge of harmful emissions, the system comprising:

a waste processing chamber having in sequence:

an opening for admitting waste into the chamber;

a first segment for receiving waste from the opening;

a second segment in communication with the first segment for holding waste preparatory to processing in subsequent segments;

a third segment in communication with the second segment for preheating the waste;

a fourth segment in communication with the third segment for heating the waste to a first selected temperature;

a fifth segment in communication with the fourth segment for heating the waste to a second selected temperature greater than the first selected temperature;

a sixth segment in communication with the fifth segment for heating the waste to a third selected temperature greater than the second selected temperature; and an outlet for discharging the processed waste from the chamber;

means for transporting the waste through the chamber in sequence from the first through to the sixth segment;

residue collecting means positioned adjacent the chamber outlet for collecting the discharged waste from the chamber outlet;

a first pair of rollers having generally parallel axes, the first pair of rollers rotatably affixed within the third segment a first distance apart for mechanically reducing pieces of waste passing therebetween;

a second pair of rollers having generally parallel axes, the second pair of rollers rotatably affixed within the fourth segment a second distance smaller than the first distance apart for further mechanically reducing pieces of waste passing therebetween;

a third pair of rollers having generally parallel axes, the third pair of rollers rotatably affixed within the fifth segment a third distance smaller than the second distance apart for yet further mechanically reducing pieces of waste passing therebetween; and a fourth pair of rollers having generally parallel axes, the fourth pair of rollers rotatably affixed within the sixth segment a fourth distance smaller than the third distance apart for even further mechanically reducing pieces of waste passing therebetween;

wherein:

the second, the third, and the fourth pair of rollers comprise a material suitable for use as an anode for an electric arc;

each pair of rollers is dimensioned and positioned so that all solid waste entering a respective chamber segment must pass between the respective pair of rollers;

a first one of each roller pair is adapted to rotate in an opposite direction to a rotation of a second one of each roller pair to impel waste impinging thereon to proceed therebetween; and the roller pair rotations are directed to move waste sequentially from the third through to the sixth segment;

and further comprising:

means for admitting an inert gas into the chamber;

a first set of unrestricted plasma arc torches, each adapted to protrude into the fourth segment, each having an electrode tip pointing generally toward a central region of the fourth segment, each electrode tip positioned at most a maximum firing distance away from the second pair of rollers;

a second set of unrestricted plasma arc torches, each adapted to protrude into the fifth segment, each having an electrode tip pointing generally toward a central region of the fifth segment, each electrode tip positioned at most a maximum firing distance away from the third pair of rollers;

a third set of unrestricted plasma arc torches, each adapted to protrude into the sixth segment, each having an electrode tip pointing generally toward a central region of the sixth segment, each electrode tip positioned at most a maximum firing distance away from the fourth pair of rollers;

means for firing the torches at a voltage sufficient to create an arc between the electrode tips and the respective pair of rollers, the arc sufficient to ionize a sufficient amount of the inert gas to form an unrestricted arc plasma from the inert gas, the arc plasma having a temperature sufficient to decompose the waste and render the hazardous component nonhazardous; and means for sustaining an electric current flow from the electrode tips to the respective pair of rollers; and wherein:

each unrestricted plasma arc torch when fired creates a conically shaped plasma cloud; and in use the conically shaped plasma cloud of each torch interacts with and overlaps a conically shaped plasma cloud of an adjacent torch member of the respective set of torches to form a defined cloud region having a temperature higher than a temperature achievable by a unitary torch.

2. The waste disposal system recited in claim 1, further comprising:

means for educting hot gases from the third segment; and a filter connected to the educting means for filtering the educted hot gases to remove carbon black.

3. The waste disposal system recited in claim 2, further comprising:

means for cleaning the educted hot gases positioned downstream of the filter;

means for transporting the hot gases from the filter to the cleaning means;

means for reclaiming inert gas from the educted hot gases positioned downstream of the cleaning means;

means for transporting the hot gases from the cleaning means to the reclaiming means; and means for transporting the reclaimed inert gas from the reclaiming means to the inert gas admitting means.

4. The waste disposal system recited in claim 1, wherein the first, the second, and the third set of plasma torches each comprises three plasma torches.

5. The waste disposal system recited in claim 1, wherein the inert gas comprises argon.

6. The waste disposal system recited in claim 1, further comprising a first, a second, a third, and a fourth temperature sensing means for sensing the temperature in the third, the fourth, the fifth, and the sixth chamber segments, respectively.

7. The waste disposal system recited in claim 6, further comprising six sensor means for sensing the presence of waste in each chamber segment.

8. The waste disposal system recited in claim 7, further comprising means responsive to the temperature sensor means and the waste presence sensor means for controlling the waste transporting means for ensuring a selected sequence of events in the processing of the waste.

9. The waste disposal system recited in claim 1, wherein the first through the sixth segments are positioned in a generally top-to-bottom configuration, the first segment being the topmost segment and the sixth segment being the bottommost segment, and wherein the means for transporting the waste comprises a gravity feed.

10. The waste disposal system recited in claim 1, further comprising means for sealing off the chamber opening and the chamber outlet during waste processing for retaining the inert gas and the processed waste within the chamber.

11. The waste disposal system recited in claim 1, further comprising heat exchanger and circulating means for recovering heat from the chamber outlet and transferring the recovered heat to the third segment to facilitate preheating of the waste therein.

12. The waste disposal system recited in claim 1, wherein the third pair of rollers attains a temperature sufficient to vaporize a liquid component of the waste impinging on the rollers.

* * * * *